US006581497B1

(12) United States Patent
Kelton

(10) Patent No.: US 6,581,497 B1
(45) Date of Patent: Jun. 24, 2003

(54) CONTAINER-RESTRAINING AND CLOSURE-ROTATING ASSEMBLY

(76) Inventor: Ricky L. Kelton, 2052 N. 26th Cir., Mesa, AZ (US) 85213

( * ) Notice: Subject to any disclaimer, the term of this patent is extended or adjusted under 35 U.S.C. 154(b) by 0 days.

(21) Appl. No.: 10/133,593

(22) Filed: Apr. 26, 2002

(51) Int. Cl.[7] ..... B67B 7/14

(52) U.S. Cl. ..... 81/3.32; 81/3.43; 81/3.36; 81/3.39

(58) Field of Search ..... 81/3.09, 3.25, 81/3.31, 3.32, 3.35, 3.36, 3.29, 3.39, 3.43, 3.4, 3.42, 64

(56) References Cited

U.S. PATENT DOCUMENTS

| | | | | | |
|---|---|---|---|---|---|
| 710,606 | A | | 10/1902 | Pagett | |
| 1,299,511 | A | * | 4/1919 | Scharnberg | 81/3.43 |
| 2,076,813 | A | * | 4/1937 | Fiedler | 81/3.43 |
| 2,086,674 | A | * | 7/1937 | Lodin | 81/3.32 |
| 2,531,052 | A | * | 11/1950 | Kehoe | 81/3.32 |
| 2,718,800 | A | | 9/1955 | Olson | |
| 2,937,548 | A | | 5/1960 | McKim | |
| 3,851,548 | A | * | 12/1974 | Rutz | 81/3.43 |
| 4,082,016 | A | * | 4/1978 | Vonusa | 81/3.43 |
| 4,102,226 | A | * | 7/1978 | McGuire | 81/3.32 |
| 4,660,445 | A | | 4/1987 | Windom | |
| 5,329,831 | A | | 7/1994 | Pierce et al. | |

* cited by examiner

*Primary Examiner*—D. S. Meislin
(74) *Attorney, Agent, or Firm*—John D. Lister

(57) ABSTRACT

A container-restraining and closure-rotating assembly includes a base plate with a container-gripping strap that tightens about a sidewall of a container located on a counter beside the base plate when a counterclockwise rotational force is applied to the container and a closure-rotating implement for rotating and unscrewing a closure on a container restrained by the container-gripping strap. The closure-rotating implement includes a closure-gripping strap that tightens about a sidewall of a closure when a counterclockwise rotational force is applied to the closure through the closure-gripping strap by a counterclockwise movement of the implement handle.

8 Claims, 3 Drawing Sheets

CONTAINER-RESTRAINING AND CLOSURE-ROTATING ASSEMBLY

BACKGROUND OF THE INVENTION

The subject invention relates to a container-restraining and closure-rotating assembly and, in particular, to such an assembly that enables an individual with arthritis, tendonitis, carpel tunnel syndrome, aching joints, or many other typically painful hand related problems to quickly and easily break the seal and open the threaded closure of a large or small container without the pain normally associated with such activity by a person suffering from one of the above bodily disorders. The subject invention also provides a means for people to open containers who do not otherwise have the strength to break the seal and open the threaded closure of a container, such as elderly people and children. As used herein the term "threaded closure" or "threaded closures" includes threaded cap(s) and lid(s). As used herein the term "countertop" not only includes a flat working surface on top of waist-level kitchen cabinets, but also similar flat waist-level working surfaces such as but not limited to work bench surfaces.

There have been devices in the past with which people have tried to solve the problem of opening sealed threaded closures as exemplified in the disclosures of the following patents. However, while useful, especially for certain tasks, these approaches to solving the problem all suffer from certain shortcomings.

U.S. Pat. No. 710,606, discloses a jar holding device and cap turner. The jar holding device, while suitable for holding jars having diameters within a selected diameter range, would not be suited for holding either very small diameter or very large diameter containers. The abutment 3 with its set curvature to fit a jar is rigidly associated with the base and the adjustable abutment 4 with its similarly set curvature is adjustable on the base within certain set limits relative to the abutment 3. The abutments 3 and 4 with their set curvatures constitute a guide for and cooperate with the closure-gripping strap 5 to secure a jar against rotation and thereby restrict the size of container that be effectively held by the jar holding device. The cap-turner includes two curved arms 19 and 20 with set, curvatures that cooperate with the clamping-strap 16 to grip the cap of a container. Thus, like the jar-holding device, the cap-turner the structure of the cap-turner restricts the size of cap that can be effectively gripped and opened with the cap-turner.

U.S. Pat. Nos. 2,718,800, 2,937,548, and 4,660,445 all disclose various devices for opening container closures. However, to remove a closure from a container, these devices require the person using the device to grip and rotate the container while the device holds the closure or grip the container to keep the container from rotating with the closure as the device is used to rotate the closure. Rotating a container while a closure is being held or holding a container and keeping the container from rotating with the closure as the closure is being removed are tasks that can be quite difficult for a person suffering from a bodily disorder associated with the hands or weak due to their age. These devices may also have limited applicability. For example, while the device disclosed in U.S. Pat. No. 4,660,445, is suited for removing twist off bottle caps, one would be unable to use it to remove the closure from a gallon pickle jar.

U.S. Pat. No. 5,329,831, discloses an opener for screwed cap containers that includes two embodiments. A preferred embodiment of the opener for screwed cap containers, shown in FIGS. 1 to 5, is an electrically operated closure opener. In addition to the expense associated with the inclusion of an electric motor in this device, the apparent size of the device would require considerable counter or storage space and the need to place the container within the containment portion 22 of the device and the closure within the torque head assembly 70 would limit the size of container that can be opened with the device. Containers, such as large diameter gallon pickle jars, having larger horizontal cross sections than the horizontal cross section of the containment portion 22 could not be placed in the containment portion 22 and could not be opened with the electrically operated closure opener and containers such as baby food jars that are short in height, shorter in height than the containment portion 22 could not be opened with the electrically operated closure opener. While containers of sufficient height with closures smaller in diameter than the torque head assembly 70 could be opened with the electrically operated closure opener, containers with larger diameter closures could not be opened with the electrically operated closure opener. FIGS. 11 and 14 to 17 disclose a countertop holding base embodiment 22 in conjunction with a manually operated torque head assembly 70. However, the containment portion 22 and the torque head assembly of this embodiment of the opener for screwed cap containers would present the same problems discussed above in connection with the electrically operated closure opener.

SUMMARY OF THE INVENTION

The container-restraining and closure-rotating assembly of the subject invention solves the problems associated with the unsealing and opening of threaded container closures by individuals with arthritis, tendonitis, carpel tunnel syndrome, aching joints, and other typically painful hand related problems or a weakness by enabling such individuals to quickly and easily break the seal and open the threaded closure of essentially any size container without the pain normally associated with such activity by a person suffering from one of the above bodily disorders. In addition to fitting essentially any size container to be opened from small containers, such as but not limited to baby food jars, cough syrup bottles, beverage bottles with twist off caps, etc., to large containers, such as containers having a capacity of a gallon or more, the container-restraining and closure-rotating assembly of the subject invention is inexpensive to make, easy to mount on or remove from a countertop, easy to use, relatively compact and easy to store, and durable.

The container-restraining and closure-rotating assembly of the subject invention includes a container-restraining implement and a closure-rotating implement. The container-restraining implement includes a base plate that is detachably mounted on a countertop. The base plate is equipped with a container-gripping strap that tightens about and grips a sidewall of a container located on a countertop beside the base plate when a counterclockwise rotational force is applied to the container to restrain or prevent the container from rotating. The closure-rotating implement includes a handle and a closure-gripping strap, carried at one end of the handle, for gripping, rotating and unscrewing a threaded closure from a container restrained by the container-gripping strap of the container-restraining implement. When a counterclockwise rotational force is applied to a threaded closure through the closure-gripping strap of the closure-rotating implement by a counterclockwise movement of the implement handle, the closure-gripping strap of the closure-rotating implement tightens about a sidewall of a threaded closure to grip the closure. This counter-clockwise rotational force is transferred through the closure to the container and through the container to the container-gripping strap to tighten the container-gripping strap about the container and keep the container from rotating with the closure as the closure is being rotated by the closure-rotating implement and removed from the container. In addition to being used to loosen closures from containers, the closure-rotating implement of the subject invention can be inverted, turned upside down, and also used to tighten a threaded closure onto a container.

DESCRIPTION OF THE PREFERRED EMBODIMENTS

Figure 1:
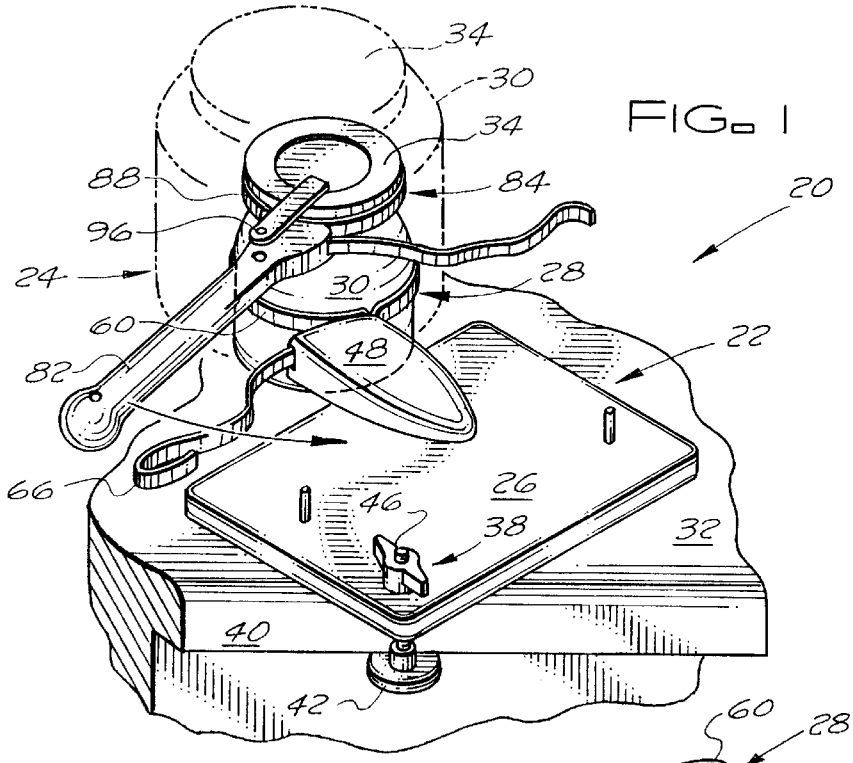
FIG. 1 is a perspective view of the container-restraining and closure-rotating assembly of the subject invention detachably mounted on a countertop.
Figure 2:
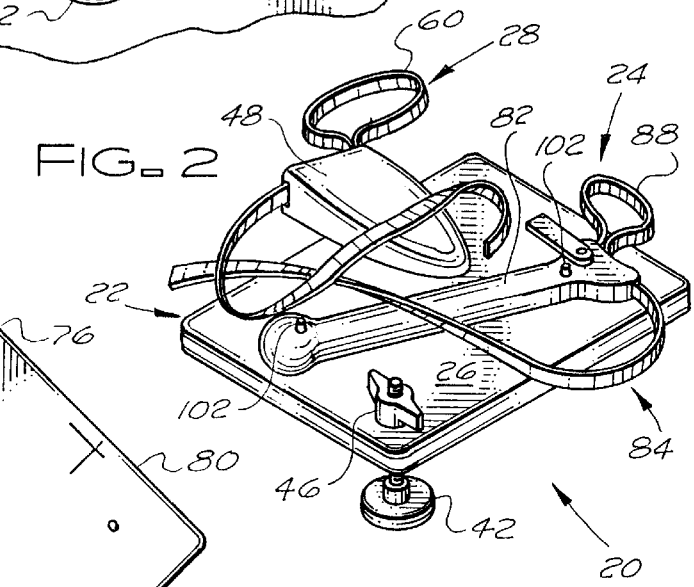
FIG. 2 is a perspective view of the container-restraining and closure-rotating assembly of the subject invention ready for storage.

As shown in FIGS. 1 and 2, the container-restraining and closure-rotating assembly 20 of the subject invention includes a container-restraining implement 22 and a closure-rotating implement 24. As shown in FIG. 2, when the container-restraining and closure-rotating assembly 20 is not in use, the closure-rotating implement 24 can be attached to the container-restraining implement 22 to form a compact assemblage for easy storage.

The container-restraining implement 22 includes a base plate 26 equipped with a container-gripping strap 28 that tightens about and grips a sidewall of a small or large container 30 located on a countertop 32 beside the base plate when a counterclockwise rotational force is applied to the container to prevent the container from rotating. The base plate 26 has a first end, a second end and a first side and a second side extending between the first and second ends.

The first end of the base plate 26 has a mounting point 36 at which the base plate is detachably anchored or secured to an edge of a countertop with a fastener 38 when the container-restraining and closure-rotating assembly 20 is being used to loosen a threaded closure 34 from a container 30. Preferably, the fastener 38 for detachably anchoring the first end of the base plate. 26 on an edge portion of a countertop 32 at the mounting point 36 of the base plate easily hooks over a lip 40 of the countertop to pivotally secure the base plate 26 to the countertop at the mounting point 36. As shown, the fastener 38 has a head portion 42 with annular horizontally extending flange, a threaded shank portion 44 extending upward from the head portion 42, and a wing lock nut 46. The threaded shank portion 44 of the fastener 38 is threaded through a threaded opening in the base plate 26 with the head portion 42 the fastener projecting beneath the base plate and the wing lock nut 46 of the fastener threaded onto the shank above the base plate. The spacing of the head portion 42 of the fastener 38 beneath the underside of the base plate 26 is adjusted by threading the shank portion 44 into or out of the threaded opening in the base plate until the flange of the head portion 42 can easily but snuggly slide beneath the lip of a countertop. The wing lock nut 46 is then tightened to hold the head portion 42 at the selected spacing beneath the underside of the base plate 26 and the container-restraining implement 22 can be quickly and easily mounted on or detached from the lip 40 of a countertop 32.

Figure 10:
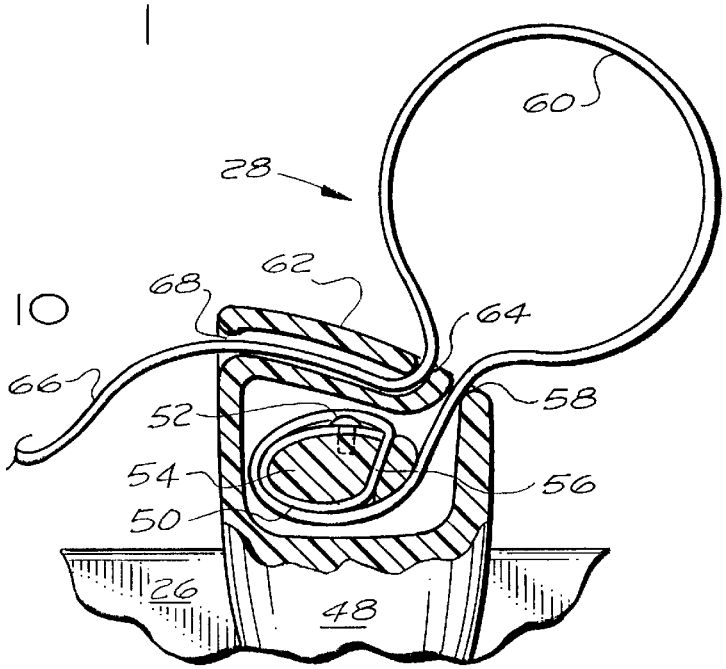
FIG. 10 is a plan view, with a portion broken away, of the mounting of the container-gripping strap in the container-restraining implement on the base of the container-restraining and closure-rotating assembly of the subject invention. A plan view of the mounting of the closure-gripping strap in the closure-rotating implement of the subject invention, in its normal or uninverted position, is a mirror image of the mounting of the container-gripping strap shown in FIG. 10.

When the base plate 26 of the container-restraining implement 22 is mounted on a countertop 32 at the mounting point 36 by the fastener 38, for a person using the container-restraining and closure-rotating assembly facing the countertop, the first side of the base plate 26 extends to the left of the mounting point 36 and forms the left side of the base plate and the second side of the base plate extends to right of the mounting point 36 and forms the right side of the base plate. The container-gripping strap 28 is secured to the base plate 26 through a mounting head 48 which projects from the left side of the base plate. The preferred method of securing a first end 50 of the container-gripping strap 28 to the mounting head 48 is shown in FIG. 10. However, the first end 50 of the container-restraining strap 28 may be secured to the mounting head 48 by other means provided the first end 50 of the strap is securely affixed to the mounting head 48.

As shown in FIG. 10, a first end 50 of the container-restraining strap 28 is secured with a conventional fastener 52 to a mounting post 54 located within a cavity in the mounting head 48. The mounting post 54 has a slot 56 therein. The first end 50 of the container-restraining strap passes from the fastener 52 about the mounting post 54 and through the slot 56 in the mounting post. The container-restraining strap 28 then loops about the mounting post 54, overlapping the first end 50 of the strap, and passes out through a slot 58. The looping of the container-restraining strap 28 over strap end 50 and about the mounting post 54, along with the fastener 52, securely attaches the first end 50 of the container-gripping strap 28 to the mounting head 48. After passing out through the slot 58 in the mounting head 48, the container-gripping strap 28 is formed into a loop 60 for receiving a container 30 to be held against rotation when a threaded closure 34 is being removed from the container. The mounting head 48 has a strap engaging surface 62, which may be serrated, with a slot 64 therein. The free end 66 of the container-gripping strap 28 passes in through the slot 64 and out through a slot 68 in a sidewall of the mounting head 48. After a container 30 is placed in the loop 60 and the free end 66 of the container-gripping strap 28 is pulled to bring the strap into contact with and position the container-gripping strap 28 on the sidewall of the container 30, a counterclockwise torque on the container 30 automatically tightens the container-gripping strap about the sidewall surface of the container 30 with a portion of the strap loop 60 clamped between the sidewall surface of the container 30 and the strap engaging surface 62 of the mounting head 48 to firmly hold or restrain the container from counterclockwise rotation.

The container-gripping strap 28 may be any desired length to accommodate any size container to be opened. The container-gripping strap 28 is sufficiently flexible and resilient to be looped about very small diameter containers without assuming a permanent deformity, sufficiently strong to withstand the forces required to firmly grip and hold small or large diameter containers without failing or breaking, and has a coefficient of friction large enough to firmly grip the sidewalls of small or large diameter containers without slipping to restrain such containers against rotation when a closure 34 of the container is being removed by the closure-rotating implement 24. Preferably, the container-gripping strap 28 as the strap extends from the mounting head to form the loop 60 is located a distance above the underside of the base plate 26 so that the loop 60 of the container-gripping strap 28 will be spaced above the countertop 32 when the container-restraining implement is mounted on the countertop, e.g. ⅝ of an inch or more. With the loop 60 of, the container-gripping strap 28 positioned above the countertop 32, the loop 60 of the container-gripping strap 28 will grip the cylindrical sidewall surface of a container 30 positioned on the countertop alongside the mounting head 48 above the bottom most portion 69 of the container which may be rounded inwardly, e.g. rounded inwardly like the bottom of some peanut butter jars, instead of at the bottom most portion 69 where the loop 60 would not get as good a grip on the container.

Figure 3:
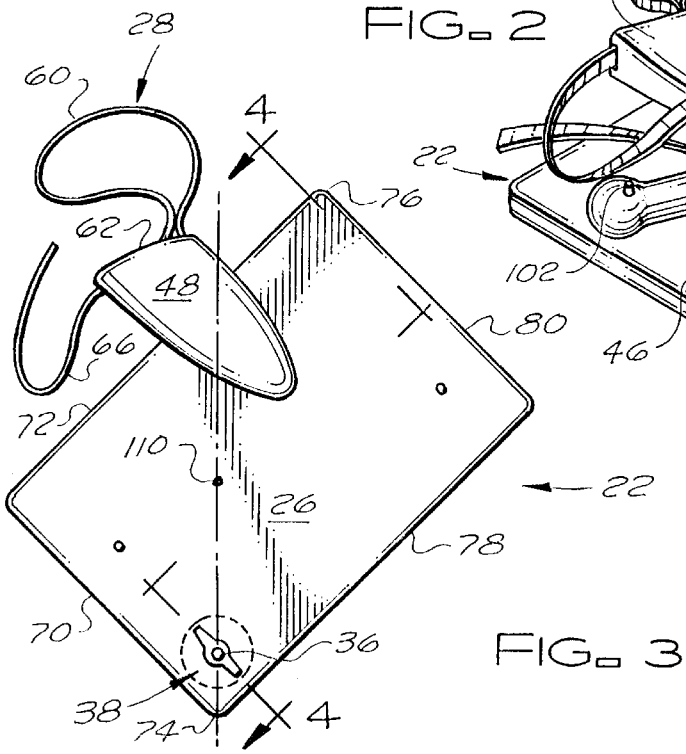
FIG. 3 is a plan view of the base of the container-restraining and closure-rotating assembly of the subject invention.
Figure 4:
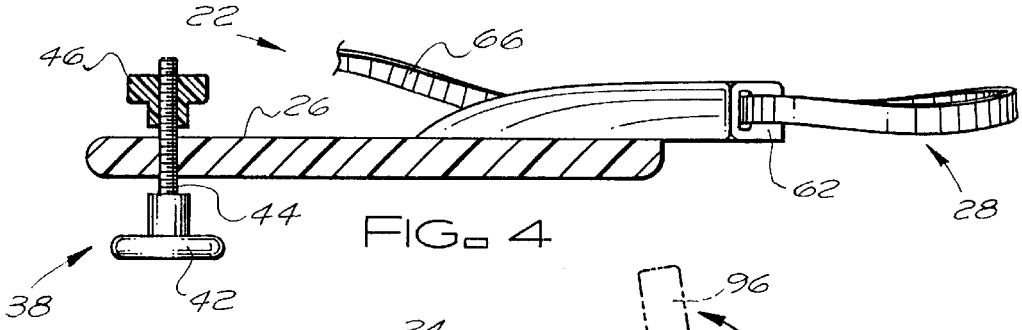
FIG. 4 is a cross section of the base of the container-restraining and closure-rotating assembly of the subject invention taken substantially along lines 4—4 of FIG. 3.

Preferably, as shown in FIG. 3, the base plate 26 is generally rectangular or diamond shaped. When the base plate 26 is properly mounted on the lip 40 of a countertop 32 at the mounting point 36 at the first end of the base plate, the left side of the base plate 26 has first and second edge portions 70 and 72 extending between the first end 74 and the second end 76 of the base plate 26 and the right side of the base plate 26 has first and second edge portions 78 and 80 extending between the first end and the second end of the base plate 26. As stated above, the mounting head 48 is on and extends outwardly from the left side of the base plate 26. Preferably, the mounting head 48 extends outwardly from the second edge portion 72 on the left side of the base plate 26 with the strap engaging surface 62 of the mounting head, where a portion of the loop 60 of the container-gripping strap 28 is clamped between the sidewall of the container 30 and the strap engaging surface 62 when the container-restraining implement is in use, being located inward from the edge of the countertop 32, being located left of an imaginary line 110 extending from the mounting point 36 of the base plate 26 perpendicular to the countertop edge at the mounting point 36, and facing inward or away from the mounting point 36 (e.g. facing as shown in FIG. 3 at an angle of about 30° to a perpendicular line to the imaginary line 110).

Figure 8:
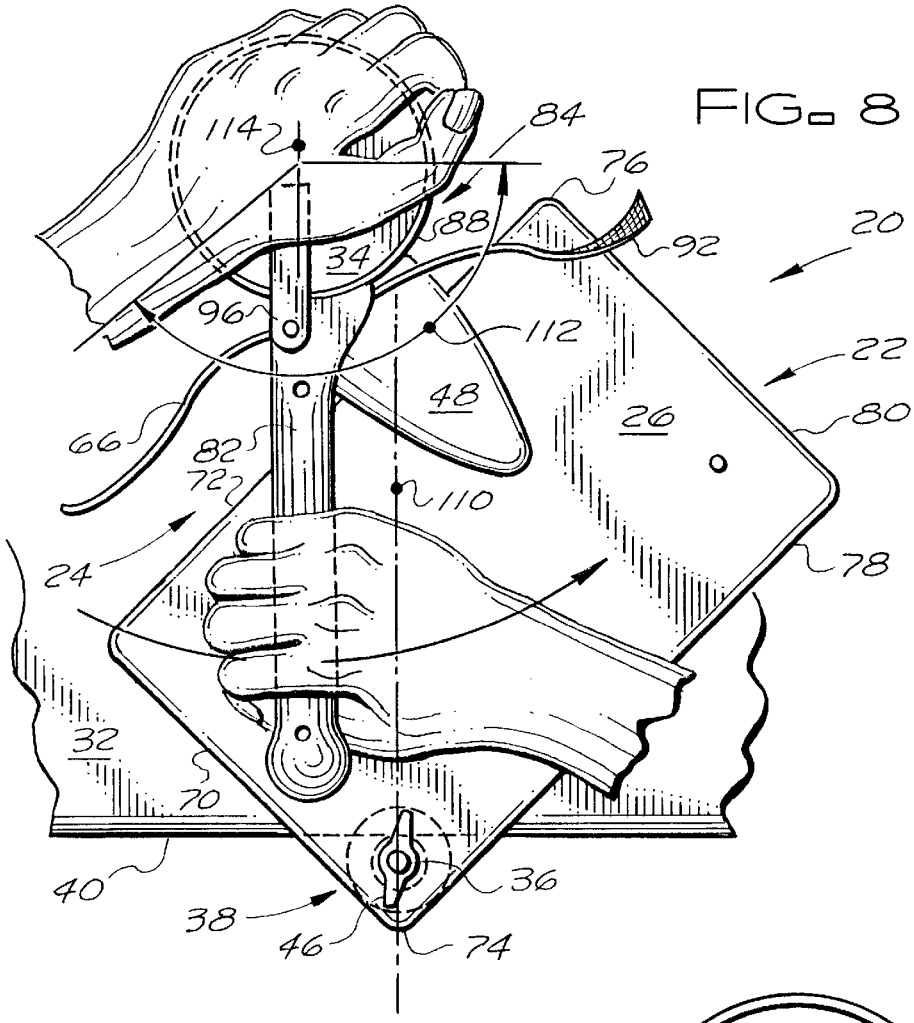
FIG. 8 is a plan view of the container-restraining and closure-rotating assembly of the subject invention, detachably mounted on a countertop as in FIG. 1, with a closure being removed from a container.

When operating the container-restraining and closure-rotating assembly 20 to open a container, the most convenient or preferred arc through within which the operator can move the handle 82 of the closure-rotating implement 24 to apply torque to the container closure 34 to loosen the closure is an arc 112 shown in FIG. 8 extending from about 60° to the left to about 90° to the right of an imaginary line 114 extending perpendicular to the countertop edge through the closure 34. With the strap engaging surface 62 of the mounting head 48 located inward and to the left of the mounting point 36, when a counterclockwise torque is applied to the container 30 through the closure 34 by the counterclockwise rotation of the closure-rotating implement 24 by moving or at least commencing the movement of the handle 82 of the closure-rotating implement 24 within preferred arc 112, the forces transferred from the container 30 through the loop 60 of the container-gripping strap 28 and the strap engaging surface 62 of the mounting head 48 to the base plate 26 stabilize the basplate about the mounting point 36 so that the base plate does not tend to rotate about the mounting point 36 or so that a slight pressure applied to the top of the closure 34 by the operator with the palm and/or heel of the hand as shown in FIG. 8 stabilizes the assembly and stops any movement of the base plate 26. If the mounting head 48 extended outward from the edge portion 80 on the right side of the base plate 26 with the strap engaging surface on the right side of the imaginary line 110 extending from the mounting point 36 of the base plate 26 perpendicular to the countertop edge at the mounting point 36 and the operator were to attempt to apply torque to a container closure by moving the handle of the closure-rotating implement 24 within the preferred arc, the forces transferred to the base plate through the mounting head would destabilize the base plate and tend to rotate the base plate about the mounting point 36. Thus, the placement of the strap engaging surface 62 of the mounting head 48 to the left of the imaginary line 110 is greatly preferred. It is contemplated that the base plate 26 may have other preferred configurations provided the container-gripping strap 28 and the strap engaging surface 62 of the mounting head 48 are located on the left side of the base plate to the left of the imaginary line 110 extending from the mounting point 36 perpendicular to the counter edge at the mounting point to function in substantially the same way as the container-gripping strap 28 and strap engaging surface 62 as shown in the FIGS. 1 to 3, 7, 8 and 10.

The closure-rotating implement 24 includes the handle 82 and a closure-gripping strap 84, carried at one end of the handle, for gripping, rotating and unscrewing a threaded closure 34 on a container 30 restrained by the container-gripping strap 28 of the container-restraining implement 22. The closure-gripping strap 84 is anchored in a mounting head 86. The mounting of one end of the closure-gripping strap 84 in the mounted head 86 is essentially the same as the mounting of the end 50 of the container-gripping strap 28 in the mounting head 48, with one exception, the mounting of the closure-gripping strap 84 in the mounting head 86 is a mirror image of the mounting of the end 50 of the container-gripping strap 28 in the mounting head 48. The wrapping and looping of the one end of the closure-gripping strap 84 about the mounting post within the mounting head 86 securely attaches the first end of the closure-gripping strap 84 to the mounting head 86. After passing out through a slot in the mounting head 86 corresponding to the slot 58 in the mounting head 48, the closure-gripping strap 84 is formed into a loop 88 for receiving a container closure 34 to be removed from the container 30. The mounting head 86 has a strap engaging surface 90, which may be serrated, with a slot therein corresponding to the slot 64 in the strap engaging surface 62 of the mounting head 48. The free end 92 of the closure-gripping strap passes in through the slot in the strap engaging surface 90 and out through a slot 94 in the sidewall of the mounting head 86. After a container closure 34 is placed in the loop 88 and the free end 92 of the closure-gripping strap 84 is pulled to bring the strap into contact with and position the strap 84 about the container closure 34, a counterclockwise torque on the container closure 34 automatically tightens the closure-gripping strap 84 about the container closure with a portion of the strap clamped between a sidewall of the container closure 34 and the strap engaging surface 90 of the mounting head 86 to firmly grip the container closure 34 for counterclockwise rotation.

The closure-gripping strap 84 may be any desired length to accommodate any size closure to be opened. The closure-gripping strap 84 is sufficiently narrow for use on essentially any commercial container closure, sufficiently flexible and resilient to be looped about very small diameter closures without assuming a permanent deformity, sufficiently strong to withstand the forces required to firmly grip and rotate small or large diameter closures without failing or breaking, and has a coefficient of friction large enough to firmly grip the sidewalls of small or large diameter closures without slipping when breaking a seal and rotating a closure 34 to remove the closure with the closure-rotating implement 24.

As shown in FIGS. 5 to 9, the closure-rotating implement 24 includes an alignment tab 96 that is pivotally mounted on the top of the mounting head 86. In a first position, shown in FIGS. 5, 6 and 8, the alignment tab 96 extends beyond strap engaging surface 90 of the mounting head 86 and facilitates the vertical alignment of the loop 88 of the closure-gripping strap 84 with the sidewall of the closure 34 when placing the loop 88 about the closure 34. For other closures, such as the odd shaped closure 98 of FIG. 9, the alignment tab 96 can be pivoted out of the way to the position shown in phantom line in FIG. 5 and solid line in FIG. 9.

Figure 5:
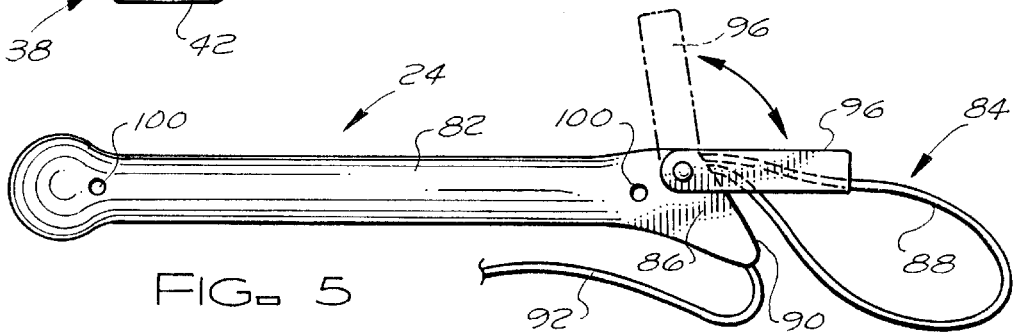
FIG. 5 is a top view of the closure-rotating implement of the container-restraining and closure-rotating assembly of the subject invention.
Figure 6:
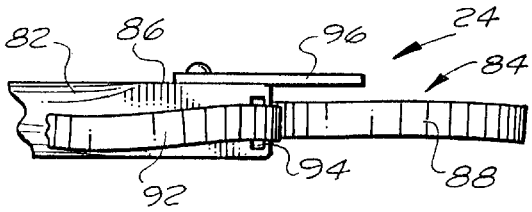
FIG. 6 is a partial side view of the closure-rotating implement of FIG. 5.
Figure 9:
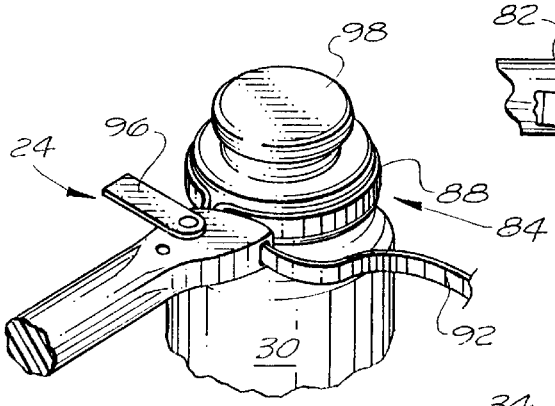
FIG. 9 is a perspective view of the closure-rotating implement of FIGS. 5 and 6, being used in the inverted position to screw and tighten a closure onto a container.
Figure 7:
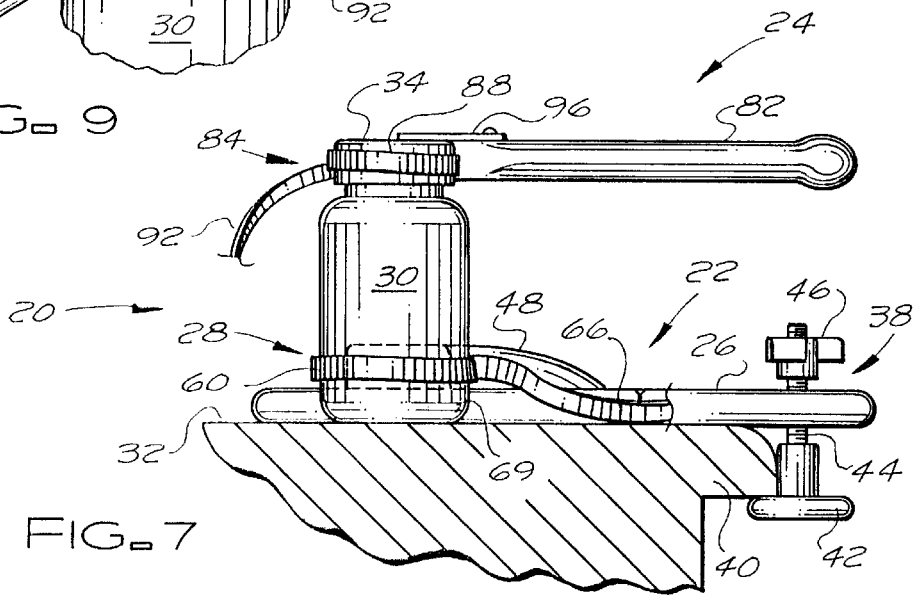
FIG. 7 is a side view of the container-restraining and closure-rotating assembly of the subject invention detachably mounted on a countertop as in FIG. 1.

With the alignment tab 96 pivoted out of the way in the position shown in phantom line in FIG. 5 and solid line in FIG. 9, the closure-rotating implement 24 can be inverted, turned upside down, and also used to tighten a threaded closure 34 onto a container 30. With the closure-rotating implement 24 inverted and the closure-gripping strap 84 encircling and engaging a closure of a container 30, a clockwise rotational force applied to the container closure 34 by a clockwise rotational movement of the handle 82 tightens the closure-gripping strap 84 about the container closure so that the clockwise rotational movement of the handle of the closure-rotating implement rotates the container closure clockwise relative to a container to screw the container closure onto the container.

Preferably, the handle 82 of the closure-rotating implement 24 has a pair of holes 100 therein. These holes 100 may be used to store the closure-rotating implement 24 on the container-restraining implement 22 by sliding the holes of the handle 82 over the pegs 102 in the base plate 26.

In a preferred method of utilizing the container-restraining and closure-rotating assembly 20, the container-restraining implement 22 is mounted on a countertop 32 with the detachable fastener 38 hooked under the lip 40 of the countertop 32. The strap engaging surface 62 of the mounting head 48 is located on the countertop 32 to the left of the imaginary line 110 passing inward from the mounting point 36 and perpendicular to the edge of the countertop at the mounting point 36. The strap engaging surface 62 of the mounting head 48 is inward of and facing away from the mounting point 36. A container 30 of essentially any selected size is placed through the loop 60 and onto the countertop 32 adjacent the strap engaging surface 62 of the mounting head 48. The free end 66 of the container-gripping strap 28 is pulled with just enough force to snug down the loop 60 onto the outside cylindrical surface of the container 30 and position a portion of the loop 60 intermediate the strap engaging surface 62 of the mounting head and the sidewall of the container 30. The closure-gripping strap 84 of the closure-rotating implement 24 is placed over and around the threaded closure 34 of the container 30 with the handle 82, preferably, pointing generally toward the operator and in the preferred arc 112. The free end 92 of the closure-gripping strap 84 is pulled with just enough force to snug down the loop 88 on the outside cylindrical surface of the closure 34. Then, the operator moves the handle 82 of the closure-rotating implement 24 in a counterclockwise direction relative to the closure 34. The rotational forces (torque) resulting from this movement Of the closure-rotating implement 24 relative to the closure 34 cause the closure-gripping strap 84 to automatically tighten about and firmly grip the closure 34. The rotational forces are then imparted to the closure 34 by the closure-rotating implement. These rotational forces are transferred through the closure 34 to the container 32 and from the container 32 to the loop 60 in the container-gripping strap that is automatically tightened about and firmly grips the sidewall of the container 30 to keep the container 30 from rotating. With the container 30 retrained from rotation by the container-restraining implement, the rotational forces (torque) exerted on the closure 34 by the closure-rotating implement breaks the closure seal and unthreads and loosens the closure 34 so that the closure can be easily removed from the container 30 with little effort. To remove the container 30 from the container-gripping strap 28 of the container-restraining implement 22, the operator merely rotates the container on the countertop 32 in a clockwise direction. When the container 30 is rotated clockwise, a portion of the container-gripping strap 28 slides back through the mounting head 48 and out through the slot 64, the loop 60 in the strap expands, and the strap loosens its grip on the container sidewall so that the container 30 can be easily lifted out of the loop 60.

In a preferred embodiment of the container-retaining and closure-rotating assembly 20, the container-restraining implement 22 and the closure-rotating implement 24 have the following dimensions. With regard to the base plate 26 of the container-restraining implement 22: the base plate 26 is about ⅝ of an inch thick, the sides 70 and 80 of the base plate are about 6 inches, and sides 72 and 78 of the base plate are about 8 inches. The mounting head 48 is about ¾ of an inch high by about 1½ inches wide. One side of the mounting head 48 projects about 1½ inches out from the side 72 while the other side of the mounting head projects about 1 inch out from the side 72. The 1 inch long side of the mounting head is 2¾ inches from the end 76 of the base plate. With regard to the closure-rotating implement 24, the handle is about 9½ inches long and about ¾ of an inch thick. The container-restraining implement 22 and the closure-rotating implement 24 may be made of various commercially available polymeric materials that can be molded into the desired shapes of the container-restraining implement 22 and the closure-rotating implement 24.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A container-restraining and closure-rotating assembly, comprising:

a base plate; the base plate having a first end and a second end; the base plate having a first side and a second side extending between the first and second ends; the base plate having a mounting point at the first end of the base plate; means for removably attaching the first end of the base plate on an edge portion of a counter at the mounting point of the base plate so that, when a user of the container-restraining and closure-rotating assembly faces the counter, the first side of the base plate is to the left of the mounting point;

a container-restraining means mounted on the first side of the base plate having a container-gripping strap for encircling and engaging an outer sidewall surface of a container located on a surface of the counter adjacent the first side of the base plate and for restraining the container from counterclockwise rotation by tightening about the outer sidewall surface of the container when a counterclockwise rotational force is applied to the container; the container-gripping strap being adjustable to fit sidewall surfaces of containers having different size and shaped horizontal cross sections; the container-restraining means including a first mounting head with a strap engaging surface facing away from the first side of the base plate, a first end of the container-gripping strap being secured within the first mounting head to the base plate, an intermediate container-gripping loop portion of container-gripping strap extending out through a first slot in the strap engaging surface of the first mounting head and in through a second slot in the strap engaging surface of the first mounting head, and a free end of the container-gripping strap extending out through a third slot in the first mounting head whereby the free end of the container-gripping strap may be pulled to bring the container-gripping strap into contact with an outer sidewall surface of a container located within the container-gripping loop portion of the container-gripping strap and a counterclockwise torque on the container automatically tightens the container-gripping loop portion of the container-gripping strap about the sidewall surface of the container with part of the container-gripping loop portion clamped between the sidewall surface of the container and the strap engaging surface of the first mounting head to restrain the container from counterclockwise rotation; and a closure-rotating means; the closure-rotating means having a handle with a first end and a second end and a closure-gripping strap at the first end of the handle for encircling and engaging a closure of a container restrained by the container-restraining means and tightening about the container closure when a counterclockwise rotational force is applied to the container closure by the closure-gripping strap through a counterclockwise rotational movement of the handle of the closure-rotating means to grip the container closure and rotate the container closure counterclockwise relative to the container being held by the container-restraining means to unscrew the container closure from the container held by the container-restraining means; and the closure-gripping strap being adjustable to fit container closures having different size and different shaped horizontal cross sections; the closure-rotating means including a second mounting head with a strap engaging surface, a first end of the closure-gripping strap being secured within the second mounting head to the handle, an intermediate closure-gripping loop portion of closure-gripping strap extending out through a first slot in the strap engaging surface of the second mounting head and in through a second slot in the strap engaging surface of the second mounting head, and a free end of the closure-gripping strap extending out through a third slot in the second mounting head whereby the free end of the closure-gripping strap may be pulled to bring the closure-gripping strap into contact with an outer sidewall surface of a container closure located within the closure-gripping loop portion of the closure-gripping strap and a counterclockwise torque on the container closure automatically tightens the closure-gripping loop portion of the closure-gripping strap about the sidewall surface of the container closure with part of the closure-gripping loop portion clamped between the sidewall surface of the container closure and the strap engaging surface of the second mounting head to rotate the container closure counterclockwise.

2. The container-restraining and closure-rotating assembly according to claim 1, wherein:

the means for removably attaching the base plate on an edge portion of a counter hooks over the edge portion of the counter to be readily attached to the counter for use and detached from the counter for storage of the container-restraining and closure-rotating assembly.

3. The container-restraining and closure-rotating assembly according to claim 1, wherein:

the container-gripping strap is spaced above a bottom surface of the base plate to be spaced above a counter surface of a counter to which the container-restraining and closure-rotating assembly is attached so that the container-gripping strap will encircle and engage a sidewall of a container at a location spaced above the bottom of the container.

4. The container-restraining and closure-rotating assembly according to claim 1, wherein:

by turning the closure-rotating means upside down the closure-gripping strap may also be used for encircling and engaging a closure of a container and tightened about the container closure when a clockwise rotational force is applied to the container closure by the closure-gripping strap through a clockwise rotational movement of the handle of the container closure-rotating means to grip the container closure and rotate the container closure clockwise relative to a container to screw the container closure onto the container.

5. The container-restraining and closure-rotating assembly according to claim 4, wherein:

the closure-rotating means includes a tab that is pivotally mounted on the first end of the handle so that the tab may be rotated between a first position where the tab extends beyond the first end of the handle immediately above the closure-gripping strap to engage a top of a container closure to help align the closure-gripping strap with the closure when the closure-rotating means is oriented to rotate a container closure counterclockwise and a second position where the tab does not extend beyond the first end of the handle so that the closure-rotating means may be turned upside down to rotate a container closure clockwise to screw a container closure onto a container.

6. The container-restraining and closure-rotating assembly according to claim 1, wherein:

the base plate includes means for releasably securing the handle of the closure-rotating means to an upper surface of the base plate for storage of the closure-rotating means with the base plate.

7. A method of using a container-restraining and closure-rotating assembly, comprising:

providing a container-restraining and closure-rotating assembly having a container-restraining means and a closure-rotating means; the container-restraining means having a base plate having a first end and a second end; the base plate having a first side and a second side extending between the first and second ends; the base plate having a mounting point at the first end of the base plate; means for removably attaching the first end of the base plate on an edge portion of a counter at the mounting point of the base plate so that, when a user of the container-restraining and closure-rotating assembly faces the counter, the first side of the base plate is to the left of the mounting point; the container-restraining means being mounted on the first side of the base plate; the container-restraining means having a container-gripping strap for encircling and engaging an outer sidewall surface of a container located on a surface of the counter adjacent the first side of the base plate and for restraining the container from counterclockwise rotation by tightening about the outer sidewall surface of the container when a counterclockwise rotational force is applied to the container; the container-restraining means including a first mounting head with a strap engaging surface facing away from the first side of the base plate, a first end of the container-gripping strap being secured within the first mounting head to the base plate, an intermediate container-gripping loop portion of container-gripping strap extending out through a first slot in the strap engaging surface of the first mounting head and in through a second slot in the strap engaging surface of the first mounting head, and a free end of the container-gripping strap extending out through a third slot in the first mounting head whereby the free end of the container-gripping strap may be pulled to bring the container-gripping strap into contact with an outer sidewall surface of a container located within the container-gripping loop portion of the container-gripping strap and a counterclockwise torque on the container automatically tightens the container-gripping loop portion of the container-gripping strap about the sidewall surface of the container with part of the container-gripping loop portion clamped between the sidewall surface of the container and the strap engaging surface of the first mounting head to restrain the container from counterclockwise rotation; and the closure-rotating means having a handle with a first end and a second end and a closure-gripping strap at the first end of the handle for encircling and engaging a closure of the container restrained by the container-restraining means and tightening about the container closure when a counterclockwise rotational force is applied to the container closure by the closure-gripping strap through a counterclockwise rotational movement of the handle of the closure-rotating means to grip the container closure and turn the container closure counterclockwise relative to the container being held by the container-gripping means to unscrew the container closure from the container held by the container-gripping means; the closure-rotating means including a second mounting head with a strap engaging surface, a first end of the closure-gripping strap being secured within the second mounting head to the handle, an intermediate closure-gripping loop portion of closure-gripping strap extending out through a first slot in the strap engaging surface of the second mounting head and in through a second slot in the strap engaging surface of the second mounting head, and a free end of the closure-gripping strap extending out through a third slot in the second mounting head whereby the free and of the closure-gripping strap may be pulled to bring the closure-gripping strap into contact with an outer sidewall surface of a container closure located within the closure-gripping loop portion of the closure-gripping strap and a counterclockwise torque on the container closure automatically tightens the closure-gripping loop portion of the closure-gripping strap about the sidewall surface of the container closure with part of the closure-gripping loop portion damped between the sidewall surface of the container closure and the strap engaging surface of the second mounting head to rotate the container closure counterclockwise;

attaching the base plate to an edge portion of a counter with the attaching means;

encircling a base portion of a container, located on a surface of the counter adjacent the first side of the base plate, with the container-gripping strap; tightening the container-gripping strap into contact with an outer sidewall surface of the container by pulling on the free end of the container-gripping strap; and further tightening the container-gripping strap about the outer sidewall surface of the container by a counterclockwise rotational movement of the container to restrain the container from further counterclockwise rotation; and encircling a closure of the container with the closure-gripping strap; tightening the closure-gripping strap into contact with an outer sidewall of the container closure by pulling on the free end of the closure-gripping strap; and further tightening the closure-gripping strap about the container closure and rotating the container closure counterclockwise by a counterclockwise rotational movement of the closure-rotating means handle to unscrew the container closure from the container.

8. The method of using a container-restraining and closure-rotating assembly according to claim 1, wherein:

while moving the handle of the closure-rotating means with a counterclockwise movement with one hand, the user exerts a downward pressure on a top of the closure with the other hand.

* * * * *